United States Patent [19]

Baloutch et al.

[11] Patent Number: 4,816,827

[45] Date of Patent: Mar. 28, 1989

[54] ROAD SAFETY INSTALLATION WITH EMISSION OF SOUND MESSAGES

[76] Inventors: Essacq Baloutch; Jacqueline Baloutch, both of 2, rue des Charentes, 21110 Genlis, France

[21] Appl. No.: 146,135

[22] PCT Filed: Apr. 14, 1987

[86] PCT No.: PCT/FR87/00123

§ 371 Date: Dec. 7, 1987

§ 102(e) Date: Dec. 7, 1987

[87] PCT Pub. No.: WO87/06381

PCT Pub. Date: Oct. 22, 1987

[51] Int. Cl.[4] ..... G08G 1/09

[52] U.S. Cl. ..... 340/905; 340/943

[58] Field of Search ..... 340/905, 943, 903, 996

[56] References Cited

U.S. PATENT DOCUMENTS

| | | | |
|---|---|---|---|
| 2,429,607 | 10/1947 | Capen | 340/905 X |
| 3,533,061 | 10/1970 | Treiterer | 340/903 |
| 3,895,344 | 7/1975 | Gill, Jr. et al. | 340/943 |
| 3,899,671 | 8/1975 | Stover | 340/905 X |
| 4,190,819 | 2/1980 | Burgyam | 340/996 |
| 4,360,795 | 11/1982 | Hoff | 340/943 |

FOREIGN PATENT DOCUMENTS

| | | | |
|---|---|---|---|
| 1814683 | 9/1969 | Fed. Rep. of Germany . | |
| 3101428 | 3/1982 | Fed. Rep. of Germany . | |
| 3129094 | 2/1983 | Fed. Rep. of Germany | 340/905 |
| 3248544 | 7/1984 | Fed. Rep. of Germany . | |
| 2135079 | 12/1972 | France . | |
| 1229321 | 4/1971 | United Kingdom | 340/905 |

*Primary Examiner*—Joseph A. Orsino
*Assistant Examiner*—Brian R. Tumm
*Attorney, Agent, or Firm*—McAulay, Fields, Fisher Goldstein & Nissen

[57] ABSTRACT

Road safety installation with emission of sound messages for every type of signalling panel fixed along a road, including a fixed emitter device emitting a coded infrared radiation signal corresponding to the type of signalling panel to which it is associated for every signalling panel along a road and on every vehicle circulating along the road, a receiver device receiving the coded infrared radiation signal (i) delivered by the fixed emitter device on every vehicle and converting the signal into a clear sound message emitted for the attention of the driver of the vehicle; the emitter device feeds an infrared radiation emitter via an encoder, so that the fixed emitter device delivers, in the direction of the vehicles arriving on the road, the coded infrared signal, and a second sensor controlling a normally open switch which is closed in order to start the emitter device in operation, when the sound sensor perceives the noise emitted by the vehicle, and the receiver device comprises an infrared radiation sensor which is mounted on the vehicle, the sensor being connected by a filtering circuit to a decoder of which the output is connected to a selector of the appropriate sound message.

11 Claims, 2 Drawing Sheets

ROAD SAFETY INSTALLATION WITH EMISSION OF SOUND MESSAGES

BACKGROUND OF THE INVENTION

The present invention relates to a road safety installation with emission of sound messages.

A driver driving a motorvehicle is guided on his way by signalling panels bordering the road. The driver is therefore obliged to remain very attentive to the signalling panel and to their signification, in order to drive carefully and thus to avoid to a maximum all risks of accidents. The driver must also now and again look at his speedometer, in order not to exceed the authorized speed limits, and at his rearview mirrors in order to keep a watch on the traffic behind his vehicle. Because of these various obligations, it is obvious that the various signalling panels warning of danger, stop, or right of way, for example, are sometimes overlooked for a number of reasons. It is therefore of the greatest importance, to warn the driver of a vehicle against any situation or danger already materialized by a fixed signalling panel.

SUMMARY OF THE INVENTION

The installation according to the invention has been designed to this effect, and its object is to give the driver a maximum of information by sound means, due to a particularly simple combination of means.

To this effect, the road safety installation according to the invention with emission of sound messages is characterized in that it comprises, for every type of signalling panel fixed along a road, a device emitting a coded infrared radiation signal corresponding to the type of signalling panel to which it is associated and, on every vehicle circulating along the road, a device receiving the coded infrared radiation signal delivered by the fixed emitter device and converting it into a clear sound message emitted for the attention of the driver of the vehicle, the emitter device comprises a source of power feeding, via an encoder, an infrared radiation emitter, so that the device delivers, in the direction of the vehicles arriving on the road, a coded infrared signal, and a sound level detector or sound sensor which controls a normally open switch which is closed in order to start the emitter device in operation, when the sound sensor perceives the noise emitted by the engine of a vehicle, and the receiver device comprises an infrared radiation sensor which is mounted on the vehicle, at the front part thereof, inside or outside, said sensor being connected to a decoder of which the output is connected to a selector of the appropriate sound message.

BRIEF DESCRIPTION OF THE DRAWINGS

One embodiment of the invention is described hereinafter, by way of example and non-restrictively, with reference to the accompanying drawings in which.

DESCRIPTION OF THE PREFERRED EMBODIMENTS

Figure 1:
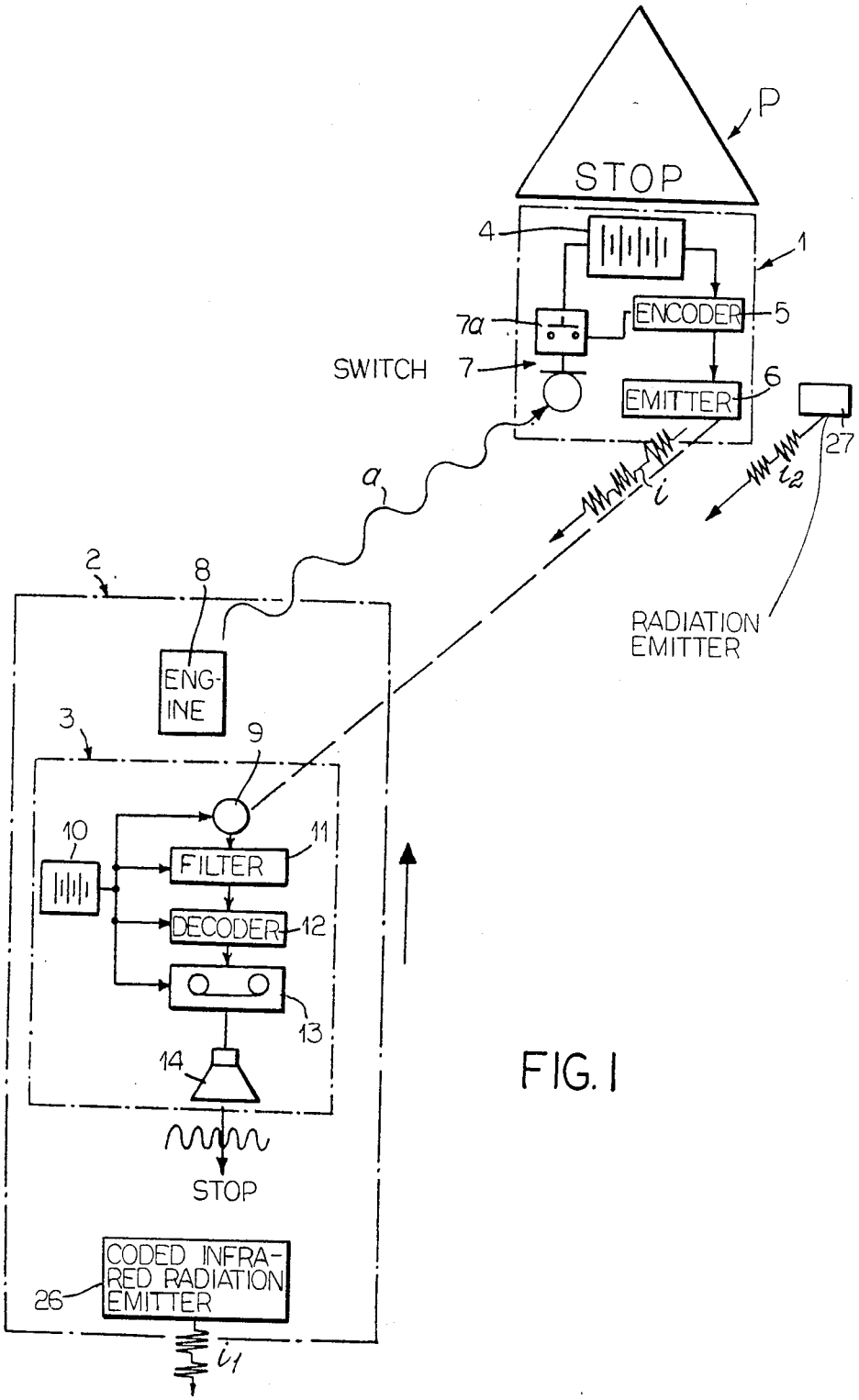
FIG. 1 is a block diagram of an emitting road safety installation according to the invention.

The installation according to the invention which is diagrammatically illustrated as a whole in FIG. 1, comprises, for each type of signalling panel fixed along a road, a device 1 emitting a coded infrared radiation signal i corresponding to the type of signalling panel P to which it is associated and, on each vehicle 2 circulating on the road, a device 3 receiving the coded infrared radiation issued from the fixed emitter device 1 and converting it into a clear sound message delivered for the attention of the driver of the vehicle. For example, in the case illustrated by way of example in FIG. 1, the emitter device 1 is associated to a "STOP" panel and the coded infrared radiation signal, once it has been decoded in the receiver device 3, becomes a clear sound message which can be as follows: "compulsory stopping. Failure to comply will entail a risk of fine and of withdrawal of the driving license".

The emitter device 1 comprises an autonomous source of power 4, such as a battery or a solar cell, or it can also be connected to the mains electrical supply if the position of the panel allows it. Said source of power 4 supplies, via an encoder 5, an infrared radiation emitter 6. The encoder 5 ensures the modulation of the infrared signal issued from emitter 6, so that device 1 emits, in the direction of the vehicles incoming on the road, the coded infrared signal i which corresponds only to the type of panel P to which the device 1 is associated.

The emitter device 1 further comprises a sound level detector or sound sensor 7 which controls a switch *7a* normally open, and which is closed to set in operation the emitter 1, when the sound sensor 7 perceives the noise a emitted by the engine of a vehicle 2.

The receiver device 3 comprises an infrared radiation sensor 9 mounted on the vehicle, at the front thereof, inside or outside, in order to obtain the best possible reception. It can be preceded by a magnifying glass, which latter is preceded by a red filter in plastic or mineral material. The infrared radiaton sensor 9 is electrically supplied, like the other components of the receiver 1, by a source of current 10 and it is connected, via a filtering circuit or filter 11, to a decoder 12 of which the output is connected to a selector 13 of the appropriate sound message. Said message selector 13 can be constituted by a cassette or hard disk recorder, a speech synthesizer LASER disk on which have been recorded a plurality of sound messages corresponding respectively to various types of signalling panels which are likely to be met along the road followed by a vehicle, each selected message being emitted by a loudspeaker 14.

Consequently, when a vehicle approaches to a predetermined distance of a signalling panel P equipped with an emitter 1, the noise of the vehicle's engine 8 is detected by the sound sensor 7, such that the switch *7a* closes, this causing the supply of the infrared radiation emitter 6, via encoder 5. The emitter 6 then emits the coded infrared signal i which is picked up, on the vehicle, by the sensor 9. The signal picked up in this way is transmitted, after filtering 11, to the decoder 12 which identifies the nature of the coded infrared signal i, and which consequently controls the message selector 13 so that that the latter emits, via the loudspeaker 14, the sound message corresponding to panel P, in this case the signal "STOP". The driver is thus informed of the closeness of such a panel and he can then react more readily even if his attention is at that moment diverted.

Figure 2:
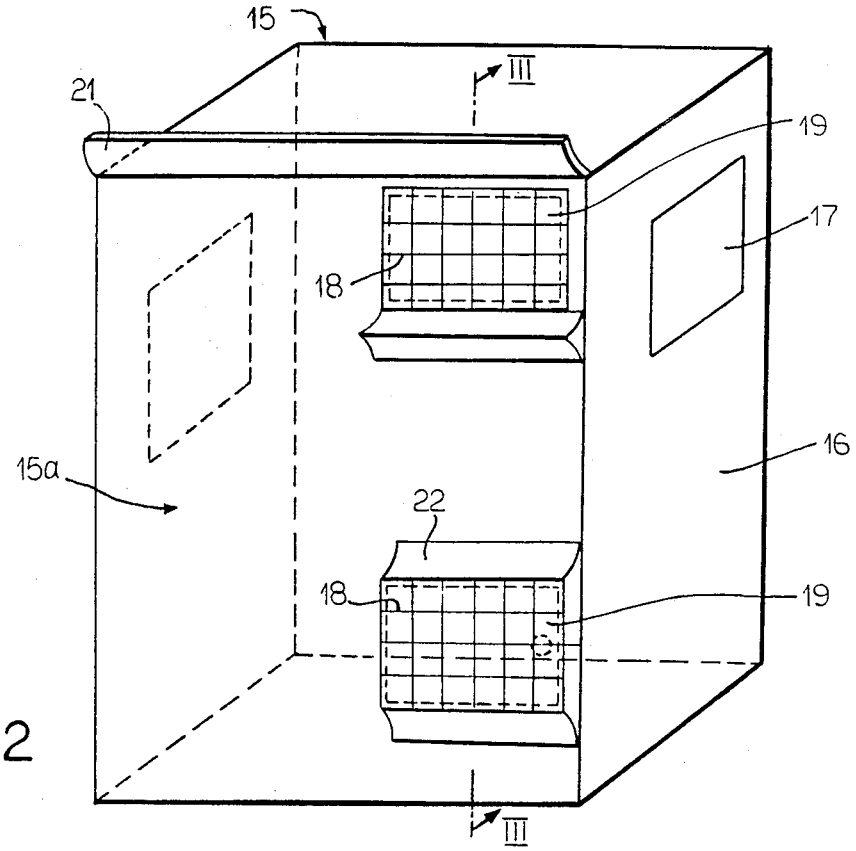
FIG. 2 is a perspective view of a coded infrared radiation emitter used in the installation according to the invention.
Figure 3:
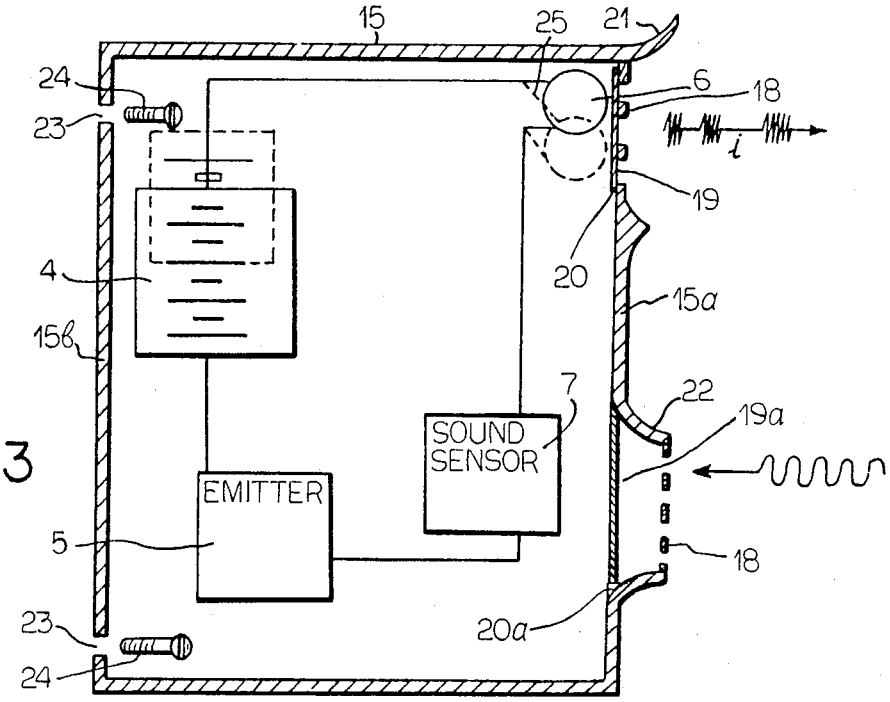
FIG. 3 is a vertical section along line III—III of FIG. 2.

As can be seen in FIGS. 2 and 3, the emitter 1 comprises a casing 15 in metal or plastic material, said casing being fixed for example to the pole supporting the signalling panel P. Said casing 15 contains all the elements of the emitter and it comprises a side door 16 giving access to said elements for maintenance or replacement purposes. A glass-plate 17 can optionally be provided, in one of the appropriately exposed walls, to allow the lighting of a solar cell situated inside and used as a generator of current. The front wall 15*a* of the casing 15 is turned so as to face towards the vehicles reaching the spot where the panel P is situated, and in said front wall 15*a* are provided openings in which grilles 18 are mounted, which grilles are backed with glass panels 19 and are provided with seals 20, 20*a* to prevent water from penetrating inside the casing 15. The pairs of grille 18 and of glass panel 19 are respectively placed in an opening of the front wall 15*a*, in front of the infrared radiation emitter 6, and in a lower opening of said wall, in front of the sound sensor 7. Projecting edges 21, 22 are respectively provided along the upper edge of the front wall 15*a* and in particular along the upper and lower openings. The upper projecting edge 21 is curved upwardly whereas the lower projecting edge 22 is curved downwardly, from the front edge 15*a*. Projecting edges 21 and 22 are provided to prevent dirt from soiling the glass panels 19.

The rear wall 15*b* of the casing is advantageously provided with holes 23 to allow the passage of screws or nuts 24 for securing the casing 15 on any appropriate support, and in particular on the pole of panel P.

As diagrammatically illustrated in FIG. 3, the infrared radiation emitter 6 can be advantageously mounted on a device 25 permitting a control of the direction of the emitted infrared radiation.

The installation according to the invention can also comprise, on every vehicle 2, in addition to the receiver 3 comprising the coded infrared radiation sensor 9 mounted at the front, a coded infrared radiation emitter 26 placed inside the vehicle, on the rear window, or outside of the rear part of the vehicle. Said emitter 26, which is thus facing towards incoming vehicles, can then emit a coded infrared signal i1 which, after being picked up by the sensor of a vehicle 2 behind, causes in that vehicle, the emission of a caution sound message for the driver, indicating to him for example that he is too close to the vehicle in front and that he risks an accident.

According to another variant of embodiment, the installation can comprise, in addition to the infrared radiation emitter 6 which is automatically set into operation when a vehicle approaches, a second infrared radiation emitter 27 which emits a second coded infrared signal i2 in cases of emergency. In such a case, for example when traffic conditions demand that vehicle drivers be warned, the second emitter is set into operation manually or by telephone or by other means, depending on the requirements.

It is also possible to use at discretion, a single infrared radiation emitter to emit the normal signal i associated to panel P, or the special coded signal i2 to warn of an emergency situation.

We claim:

1. Road safety installation with emission of sound messages, comprising, for every type of signalling panel fixed along a road, a fixed emitter device (1) emitting a coded infrared radiation signal (i) corresponding to the type of signalling panel (P) to which it is associated and, on every vehicle (2) circulating along the road, a receiver device (3) receiving the coded infrared radiation signal (i) delivered by the fixed emitter device (1) and converting the signal into a clear sound message emitted for the attention of the driver of the vehicle, the emitter device (1) comprises source of power (4) feeding, via an encoder (5), an infrared radiation emitter (6), so that the device (1) delivers, in the direction of the vehicles arriving on the road, the coded infrared signal (i), and a sound level detector or sound sensor (7) which controls a normally open switch (7*a*), which is closed in order to start the emitter device (1) in operation, when the sound sensor (7) perceives the noise (a) emitted by the engine (8) of a vehicle (2), and the receiver device (3) comprises an infrared radiation sensor (9) which is mounted on the vehicle, at the front part thereof, inside or outside, said infrared sensor being connected by a filtering circuit (11) to a decoder (12) of which the output is connected to a selector (13) of the appropriate sound message.

2. Installation according to claim 1, wherein the emitter device (1) comprises a casing (15) in metal or plastic material, of which the front wall (15*a*) is facing toward the vehicles reaching the spot where panel (P) is situated, and in said front wall (15*a*) are provided openings in which grilles (18) are mounted said grilles are backed by glass panels (19) and provided with seals to prevent water from penetrating inside the casing (15).

3. Installation according to claim 2, wherein the pairs of grilles (18) and glass panels (19) are respectively placed in an upper opening of the front wall (15*a*), in front of the infrared radiation emitter (6), and in a lower opening of said wall, in front of the sound sensor (7).

4. Installation according to claim 3, wherein projecting edges (21,22) are respectively provided along the upper edge of the front wall (15*a*) and proximate to the upper and lower openings.

5. Installation according to claim 4, wherein the upper projecting edge (21) is curved upwardly, whereas the lower projecting edge (22) is curved downwardly, from the front wall (15*a*).

6. Installation according to claim 2, wherein the infrared radiation emitter (6) is mounted on a device (25) permitting a control of the direction of the emitted infrared radiation signal.

7. Installation according to claim 1, wherein the emitter device (1) comprises means for selectively emitting a second coded infrared signal (i2) in cases of emergency, independently of the first coded infrared signal (i) associated to each panel.

8. Installation according to claim 1, wherein at the rear of every vehicle is mounted an emitter (26) emitting a coded infrared signal (i1) directed towards the back.

9. Installation according to claim 5, wherein the infrared radiation emitter (6) is mounted on a device (25) permitting a control of the direction of the emitted infrared radiation signal.

10. Installation according to claim 9, wherein the emitter device (1) comprises means for selectively emitting a second coded infrared signal (i2) in cases of emergency, independently of the first coded infrared signal (i) associated to each panel.

11. Installation according to claim 10, wherein at the rear of every vehicle is mounted an emitter (26) emitting a coded infrared signal (i1) directed towards the back.

* * * * *